US009546823B2

(12) United States Patent
Lee et al.

(10) Patent No.: US 9,546,823 B2
(45) Date of Patent: Jan. 17, 2017

(54) HEAT EXCHANGER, METHOD OF MANUFACTURING SAME, AND REFRIGERATION CYCLE APPARATUS

(71) Applicant: Mitsubishi Electric Corporation, Tokyo (JP)

(72) Inventors: Sangmu Lee, Tokyo (JP); Takuya Matsuda, Tokyo (JP); Akira Ishibashi, Tokyo (JP); Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 298 days.

(21) Appl. No.: 14/391,788

(22) PCT Filed: Apr. 23, 2013

(86) PCT No.: PCT/JP2013/061854
§ 371 (c)(1),
(2) Date: Oct. 10, 2014

(87) PCT Pub. No.: WO2013/161792
PCT Pub. Date: Oct. 31, 2013

(65) Prior Publication Data
US 2015/0101362 A1 Apr. 16, 2015

(30) Foreign Application Priority Data
Apr. 27, 2012 (WO) ..... PCT/JP2012/002897

(51) Int. Cl.
*F25B 39/02* (2006.01)
*F28D 1/02* (2006.01)
(Continued)

(52) U.S. Cl.
CPC ..... *F28D 1/0233* (2013.01); *B21D 53/02* (2013.01); *F25B 39/02* (2013.01); *F28D 1/0535* (2013.01);
(Continued)

(58) Field of Classification Search
CPC ..... F25B 39/02; F25B 39/22; H01L 23/247
(Continued)

(56) References Cited

U.S. PATENT DOCUMENTS 5,538,076 A * 7/1996 Nishida ..... F28F 9/0246 165/178
6,202,703 B1 * 3/2001 Kuroda ..... C22C 9/05 138/178
(Continued)

FOREIGN PATENT DOCUMENTS

JP 10-197175 A 7/1998
JP 2000-234883 A 8/2000
(Continued)

OTHER PUBLICATIONS

Office Action dated Jun. 29, 2016 issued in corresponding CN patent application No. 201380022321.5 (and English translation).
(Continued)

*Primary Examiner* — Melvin Jones
(74) *Attorney, Agent, or Firm* — Posz Law Group, PLC

(57) ABSTRACT

A heat exchanger includes a plurality of plate-shaped fins arranged at intervals such that air flows between adjacent fins, each of the fins having insertion holes and a plurality of flat tubes extending through the fins such that a refrigerant flows through the tubes in a stacking direction of the fins, each flat tube having a cross-section having straight long sides and half-round short sides, each flat tube having long-side outer circumferential surface parts and a short-side outer circumferential surface part in contact with the fin and
(Continued)

covered with the brazing filler metal. The fins and the flat tubes are joined with the brazing filler metal covering the outer circumferential surfaces of the flat tubes such that top part of each fin collar of each fin is in contact with the flat tube and base part of the fin collar is spaced apart from the flat tube.

6 Claims, 6 Drawing Sheets

(51) Int. Cl.

| | |
|---|---|
| ***F28D 1/053*** | (2006.01) |
| ***F28F 1/02*** | (2006.01) |
| ***F28F 1/32*** | (2006.01) |
| ***B21D 53/02*** | (2006.01) |
| *F28F 1/40* | (2006.01) |
| *F24F 1/00* | (2011.01) |

(52) U.S. Cl.
CPC ..... *F28D 1/05383* (2013.01); *F28F 1/022* (2013.01); *F28F 1/325* (2013.01); *F24F 1/0059* (2013.01); *F28F 1/40* (2013.01); *F28F 2215/12* (2013.01); *F28F 2275/04* (2013.01); *Y10T 29/49368* (2015.01)

(58) Field of Classification Search
USPC ..... 62/515, 524; 165/148, 173, 174, 181, 165/104.21
See application file for complete search history.

(56) References Cited

U.S. PATENT DOCUMENTS

| | | | | |
|---|---|---|---|---|
| 6,340,055 | B1 * | 1/2002 | Yamauchi | F28D 1/05391 165/153 |
| 2006/0169019 | A1 * | 8/2006 | Kutscher | B21D 53/04 72/379.2 |
| 2008/0302521 | A1 * | 12/2008 | Kim | B23K 1/0012 165/173 |

FOREIGN PATENT DOCUMENTS

| | | | |
|---|---|---|---|
| JP | 2001-071177 | A | 3/2001 |
| JP | 2002-018512 | A | 1/2002 |
| JP | 2002-139282 | A | 5/2002 |
| JP | 2002-172485 | A | 6/2002 |
| JP | 2006-010288 | A | 1/2006 |
| JP | 2009-281693 | A | 12/2009 |
| JP | 2010-156525 | A | 7/2010 |
| JP | 2011-127867 | A | 6/2011 |

OTHER PUBLICATIONS

International Search Report of the International Searching Authority mailed Jun. 18, 2013 for the corresponding international application No. PCT/JP2013/061854 (and English translation).
Office Action mailed Jun. 30, 2015 in the corresponding JP application No. 2014-512594 (with English translation).
Extended European Search Report dated Feb. 19, 2016 issued in corresponding EP patent application No. 13782431.4.
Office Action issued Nov. 3, 2015 in the corresponding CN application No. 201380022321.5 (with English translation).

* cited by examiner (a)

(b)

HEAT EXCHANGER, METHOD OF MANUFACTURING SAME, AND REFRIGERATION CYCLE APPARATUS

CROSS REFERENCE TO RELATED APPLICATIONS

This application is a U.S. national stage application of PCT/JP2013/061854 filed on Apr. 23, 2013, and is based on PCT/JP2012/002897 filed on Apr. 27, 2012, the contents of which are incorporated herein by reference.

TECHNICAL FIELD

The present invention relates to a heat exchanger that exchanges heat between a refrigerant and air.

BACKGROUND

Related-art heat exchangers include a heat exchanger configured such that many plate-shaped fins arranged parallel to one another are fixed with jigs, flat tubes, serving as heat transfer tubes, extend through the fins, and the fins and the flat tubes are joined with brazing filler metal for fixation (refer to Patent Literature 1, for example).

PATENT LITERATURE

Patent Literature 1: Japanese Unexamined Patent Application Publication No. 2009-281693 (FIGS. 9 to 12, for example)

In manufacturing such a heat exchanger, for example, if brazing filler metal is not properly placed, melted brazing filler metal may flow over the fins during brazing. Unfortunately, the fins may be melted. Furthermore, brazing filler metal may fail to flow into each clearance between the fin and the flat tube. This may result in poor joining of the fins and the flat tubes.

SUMMARY

The present invention has been made to solve the above-described disadvantages. An object of the present invention is to provide a heat exchanger including fins and flat tubes joined readily and reliably.

The present invention provides a heat exchanger including a plurality of plate-shaped fins arranged at intervals such that air flows between adjacent fins, and each of the fins having insertion holes, and a plurality of flat tubes extending through the fins such that a refrigerant flows through the tubes in a stacking direction of the fins, each of the flat tubes having a cross-section having straight long sides and half-round short sides, each flat tube having outer circumferential surface parts (long-side outer circumferential surface parts) along the long side of the cross-section of the flat tube and an outer circumferential surface parts (short-side outer circumferential surface parts) along the short side of the cross-section thereof in contact with the fin which are covered with the brazing filler metal. The fins and the flat tubes are joined with the brazing filler metal covering the flat tubes such that top part of each fin collar of each fin is in contact with the flat tube, base part of the fin collar is spaced apart from the flat tube, and the brazing filler metal covering the long-side outer circumferential surface parts has a thickness ranging from three to seven percent of a total thickness of the flat tube.

According to the present invention, the flat tubes and the plate-shaped fins can be joined readily and reliably by brazing with the brazing filler metal covering the flat tubes.

DESCRIPTION OF EMBODIMENTS

Embodiment 1

Figure 1:
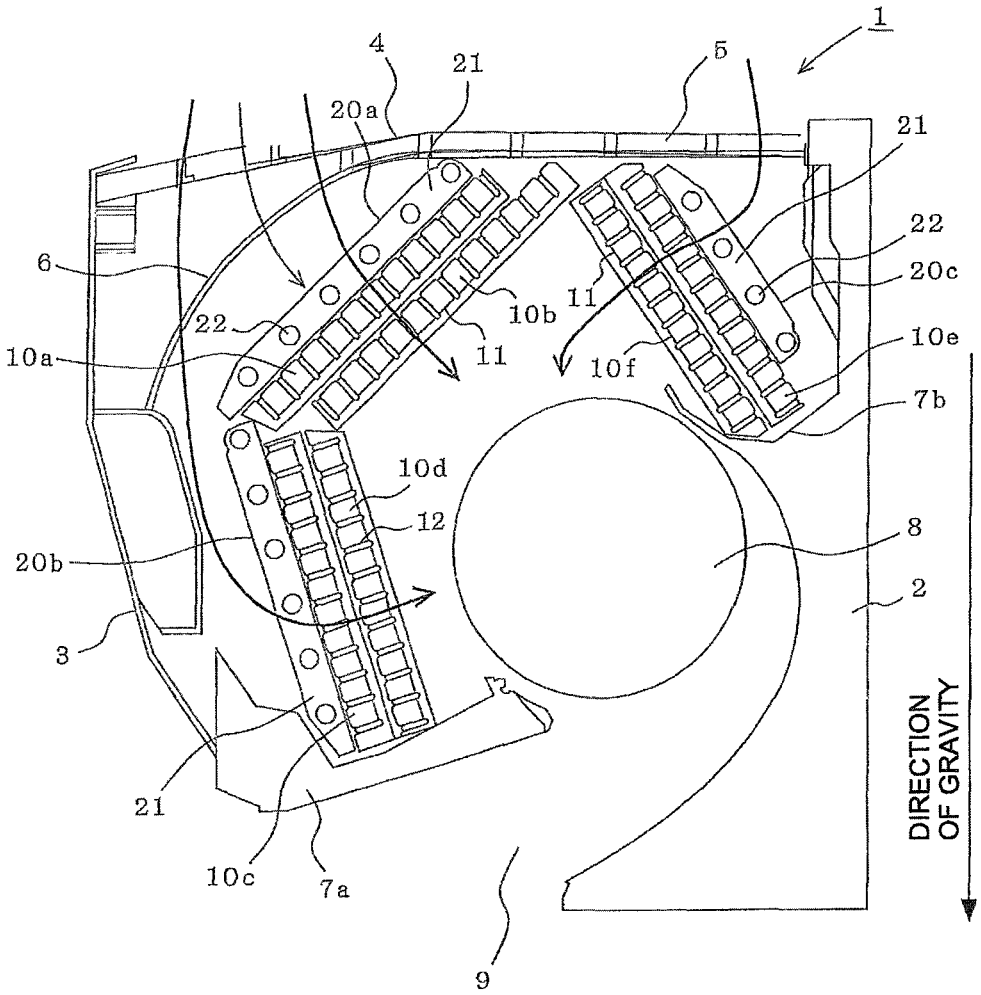
FIG. 1 is a diagram illustrating the configuration of an indoor unit including heat exchangers according to Embodiment 1 of the present invention.

FIG. 1 is a diagram illustrating the configuration of an indoor unit including a heat exchanger according to Embodiment 1 of the present invention. The indoor unit, which is disposed in an air-conditioned space, included in an air-conditioning apparatus (refrigeration cycle apparatus) for conditioning air will now be described as an example. The heat exchanger according to the present invention is not limited to a heat exchanger of an indoor unit. In the following description, a left surface of the indoor unit in FIG. 1 is a front surface and a right surface thereof is a rear surface. When devices and the like do not have to be distinguished from one another or specified, subscripts may be omitted. As regards levels of temperature or pressure which will be described below, the levels are not determined in relation to a particular absolute value, but are represented based on relation relatively determined depending on, for example, a state or operation of the apparatus or the like.

In FIG. 1, an indoor unit 1 includes a casing 2, a front panel 3, and a top panel 4 interposed between the casing 2 and the front panel 3. The top panel 4 has an air inlet 5. A filter 6 is disposed inside (or downstream of) the top panel 4. Drain pans 7*a* and 7*b* receive water generated by heat exchange. A fan 8 is disposed downstream of the air inlet 5. The indoor unit 1 has an air outlet 9 disposed downstream of the fan 8.

A first main heat exchanger 10*a* and a first main heat exchanger 10*b* are arranged in two lines in an air flow direction (indicated by arrows) such that the first main heat exchangers 10*a* and 10*b* are located (between the filter 6 and the fan 8) adjacent to the front surface of the indoor unit 1 in upper part thereof. A second main heat exchanger 10*c* and a second main heat exchanger 10*d* are arranged in two lines in the air flow direction such that the second main heat exchangers 10*c* and 10*d* are located under the first main heat exchangers 10*a* and 10*b*. A third main heat exchanger 10*e* and a third main heat exchanger 10*f* are arranged in two lines in the air flow direction such that the third main heat exchangers 10*e* and 10*f* are located adjacent to the rear surface of the indoor unit 1 in the upper part thereof. Each of the first to third main heat exchangers 10*a* to 10*f* is a finned tube heat exchanger that includes plate-shaped fins 11 and flat tubes 12, serving as heat transfer tubes. The main heat exchangers (10*a* and 10*b*, 10*c* and 10*d*, and 10*e* and 10*f*) arranged in two lines are positioned such that the flat tubes 12 are staggered. In the following description, the first to third main heat exchangers 10*a* to 10*f* will be simply referred to as "main heat exchangers 10" in some cases.

An auxiliary heat exchanger 20*a*, an auxiliary heat exchanger 20*b*, and an auxiliary heat exchanger 20*c* are arranged. The auxiliary heat exchangers 20*a*, 20*b*, and 20*c* each include fins 21 and heat transfer tubes 22, which are cylindrical tubes, extending through the fins 21. The auxiliary heat exchangers 20*a*, 20*b*, and 20*c* are arranged upstream of the first to third main heat exchangers 10 in the air flow direction, respectively.

Figure 2:
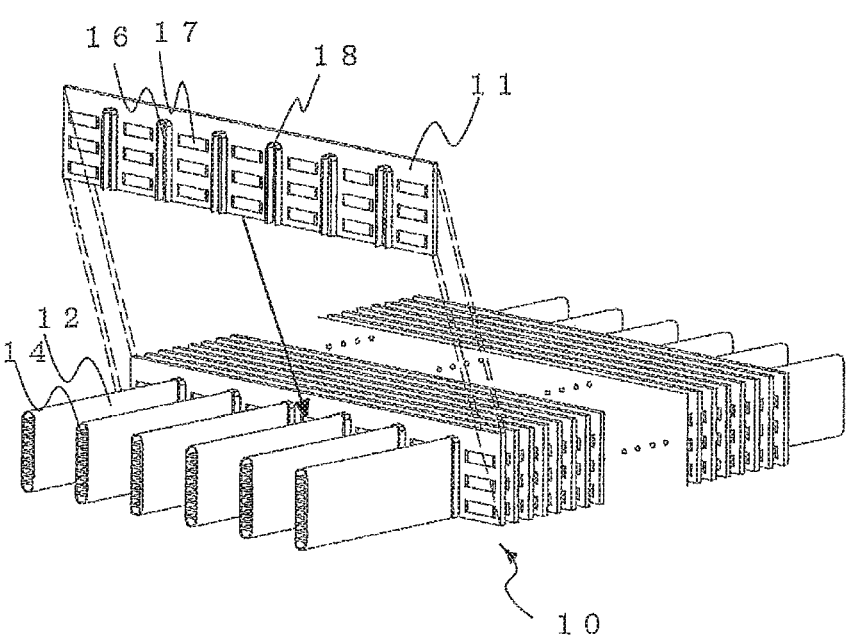
FIG. 2 includes diagrams illustrating parts of a main heat exchanger 10 in Embodiment 1 of the present invention.
Figure 2:
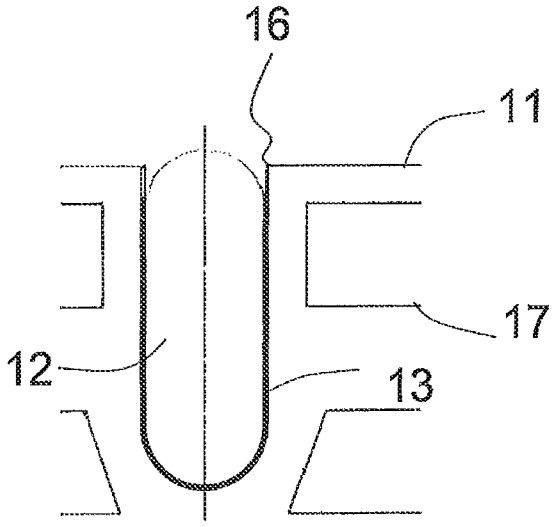

FIG. 2 includes diagrams illustrating parts of the main heat exchanger 10 in Embodiment 1 of the present invention. FIG. 2(*a*) is a partial perspective view. FIG. 2(*b*) is a partial enlarged view illustrating the relation between the fin 11 and the flat tube 12. As described above, the main heat exchanger 10 in Embodiment 1 includes the flat tubes 12, serving as flat heat transfer tubes, each having a partly curved cross-section. This flat tube heat exchanger will now be described. In FIG. 2(*a*), the main heat exchanger 10 according to Embodiment 1 includes the flat tubes 12 each having a cross-section, taken along the line perpendicular to a refrigerant flow direction, having straight long sides and curved, for example, half-round short sides. The flat tubes 12 are arranged parallel to one another at regular intervals in a direction orthogonal to the refrigerant flow direction in which the refrigerant flows through the tubes. The main heat exchanger 10 further includes the plate-shaped (rectangular) fins 11 each having insertion holes 16. The fins 11 are arranged parallel to one another at regular intervals in the refrigerant flow direction (perpendicular to the direction of arrangement of the flat tubes 12). The flat tubes 12 extend through the insertion holes 16 of the plate-shaped fins 11. In each contact portion (brazing portion 13) between the fin 11 and the flat tube 12, the fin 11 and the flat tube 12 are joined by brazing. The fin 11 and the flat tube 12 are made of aluminum or aluminum alloy. In Embodiment 1, aluminum is used as a material for the fin 11 and the flat tube 12. The use of aluminum or similar material facilitates, for example, the improvement of heat exchange efficiency, weight reduction, and downsizing. In Embodiment 1, the fin 11 is rectangular-shaped such that the length thereof along the short side of the cross-section of the flat tube 12 (or along the miner axis of the flat tube 12 viewed as an ellipse) in the direction of arrangement of the flat tubes 12 is longer than the width thereof along the long side of the cross-section of the flat tube 12 (or along the major axis of the elliptical flat tube 12). Accordingly, the direction of arrangement of the flat tubes 12 is referred to as a "lengthwise direction" and the direction along the width of the flat tubes 12 is referred to as a "widthwise direction".

Figure 3:
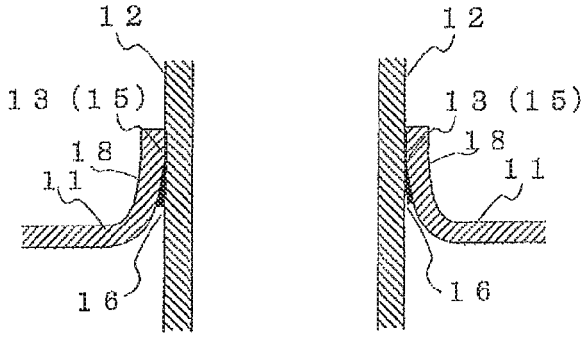
FIG. 3 is a diagram explaining a joint between a fin 11 and a flat tube 12.

FIG. 3 is a diagram explaining a joint between the fin 11 and the flat tube 12. The fin 11 has the insertion holes 16 arranged in the lengthwise direction. Since the insertion holes 16 correspond to the respective flat tubes 12, the insertion holes 16 equal in number to the flat tubes 12 are arranged in the fin 11 (except both ends) at the same intervals as those of the flat tubes 12. The fin 11 further has slits 17, serving as cut-raised portions, arranged between the insertion holes 16. In addition, the fin 11 has fin collars 18 each extending from an edge of the insertion hole 16 in a direction perpendicular to the fin 11. As for the flat tube 12 and the fin collar 18, the flat tube 12 is in contact with top part of the fin collar 18. The flat tube 12 is spaced apart from base part of the fin collar 18. The spacing between the flat tube 12 and the fin collar 18 facilitates insertion of the flat tube 12 into the insertion hole 16 of the plate-shaped fin 11. The spacing between the flat tube 12 and the fin collar 18 preferably ranges from 2 μm to 30 μm. As illustrated in FIG. 3, the flat tube 12 and the fin 11 (fin collar 18) are joined in the brazing portion 13 with brazing filler metal. Thus, the flat tubes 12 are fixed to the fins 11. As will be described later, the surface of the flat tube 12 is covered with a brazing-clad material 15. Accordingly, for example, if the spacing is less than 2 μm, it would be difficult to insert the fin collar 18 into the flat tube 12. If the spacing is greater than 30 μm, the flat tube 12 and the fin collar 18 could not be joined together effectively. Accordingly, the spacing between the flat tube 12 and the fin collar 18 ranges from 2 μm to 30 μm.

Figure 4:
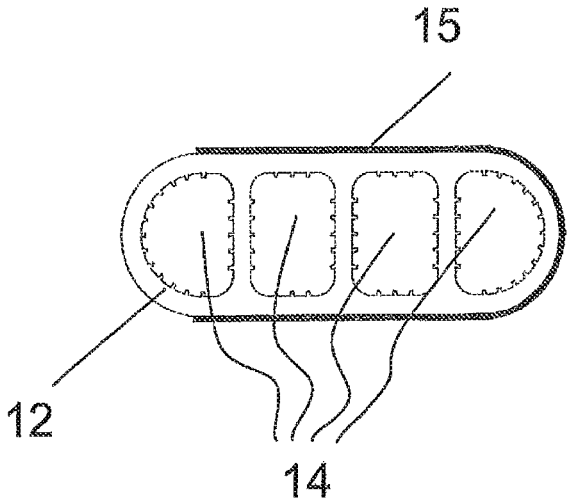
FIG. 4 is a cross-sectional view of the flat tube 12 in Embodiment 1 of the present invention.

FIG. 4 is a cross-sectional view of the flat tube 12 in Embodiment 1 of the present invention. The flat tube 12 has a plurality of holes (refrigerant passages) 14 arranged along the width of the flat tube 12. A refrigerant for heat exchange with, for example, air passing through the main heat exchanger 10 flows through the refrigerant passages 14. Each refrigerant passage 14 has a spiral groove in its inner circumferential surface. This groove allows for, for example, efficient phase change of the refrigerant, an increase in inner surface area of the tube, fluid agitation, and capillary action which results in the effect of liquid membrane retention or the like, thus improving heat transfer performance of the heat transfer tube.

In Embodiment 1, both of long-side outer circumferential surface parts of the flat tube 12 and a short-side outer circumferential part thereof to be in contact with the fin 11 are covered with the brazing-clad material 15 clad in (or coated with) brazing filler metal to be melted to braze the fin 11 and the flat tube 12. Since the fin 11 and the flat tube 12 are made of aluminum in Embodiment 1, the brazing-clad material 15 is clad in, as brazing filler metal, an aluminum-silicon (Al—Si) alloy containing aluminum and silicon.

Both of the long-side outer circumferential surface parts of the flat tube 12 and the short-side outer circumferential surface part thereof to be in contact with the fin 11 are covered with the brazing-clad material 15. The fin 11 is inserted into the flat tube 12 and is brazed to the fin 11. Accordingly, brazing is easily achieved. In addition, brazing is achieved such that brazing filler metal is evenly spread over each brazing portion 13. Although an aluminum plate, serving as the fin 11, may be coated with a brazing-clad material, for example, a die for shaping the fin 11 may be easily broken because brazing filler metal is an alloy harder than aluminum, leading to an increase in processing cost. Additionally, if the aluminum plate which is to be the fin 11 is coated with the brazing-clad material, it would be difficult to perform processing for formation of the fin 11. Consequently, it would be difficult to ensure the height of the slit, leading to a reduction in heat exchange performance. In Embodiment 1, therefore, the flat tube 12 is covered with the brazing-clad material 15.

As described above, the heat exchanger according to Embodiment 1 is configured such that the fins 11 and the flat tubes 12, included in the main heat exchanger 10, are joined by brazing with the brazing-clad material 15 covering both of the long-side outer circumferential surface parts of the flat tube 12 and the short-side outer circumferential surface part thereof in contact with the fin 11. In this configuration, reliable joining is readily achieved. Reliable joining allows for improvement of the heat exchange efficiency.

Embodiment 2

Figure 5:
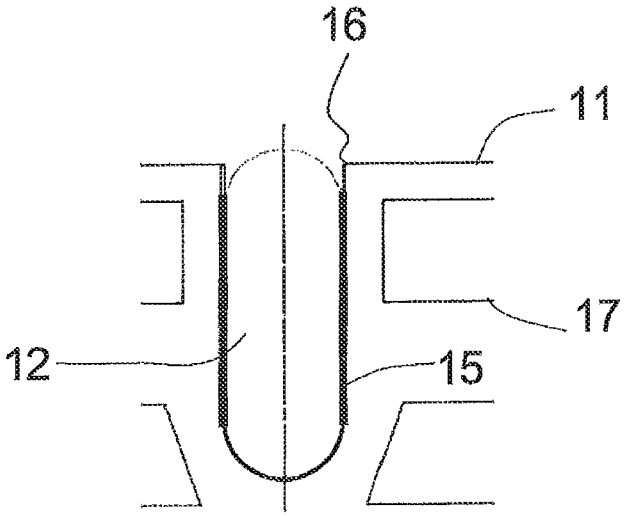
FIG. 5 is a diagram illustrating the cross-section of a flat tube 12 in Embodiment 2 of the present invention.

FIG. 5 is a diagram illustrating the cross-section of a flat tube 12 in Embodiment 2 of the present invention. As illustrated in FIG. 5, the flat tube 12 in Embodiment 2 is configured such that the thickness of a brazing-clad material 15 on a short-side outer circumferential surface part of the flat tube 12 differs from that on long-side outer circumferential surface parts thereof. For example, the brazing-clad material 15 on the short-side outer circumferential surface part is thinner than that on the long-side outer circumferential surface parts (i.e., the brazing-clad material 15 on the long-side outer circumferential surface parts is thicker than that on the short-side outer circumferential surface part). Only the long-side outer circumferential surface parts may be covered with the brazing-clad material 15 in some cases.

In Embodiment 1 described above, the whole of the outer circumferential surface of the flat tube 12 is covered with the brazing-clad material 15. For example, during brazing, melted brazing filler metal flows due to gravity or the like in some cases. In such a case, if the amount of brazing filler metal is large, excess brazing filler metal may flow over the short-side outer circumferential surface part. If the brazing filler metal is solidified as it is, the brazing filler metal protruding from the joint may reduce spacing between fins 11 so as to obstruct the flow of air through the heat exchanger. According to Embodiment 2, the brazing-clad material 15 on the short-side outer circumferential surface part is thinner than that on the long-side outer circumferential surface parts in order to prevent protrusion of melted brazing filler metal. The short-side outer circumferential surface part of the flat tube 12 is joined to the fin 11 by brazing with the brazing filler metal flowing into a clearance between the fin 11 and the flat tube 12.

As described above, the brazing-clad material 15 on the short-side outer circumferential surface part is thin in a heat exchanger according to Embodiment 2. This prevents excess brazing filler metal from flowing over the short-side outer circumferential surface part during brazing, thus eliminating obstruction of the air flow.

Embodiment 3

Figure 6:
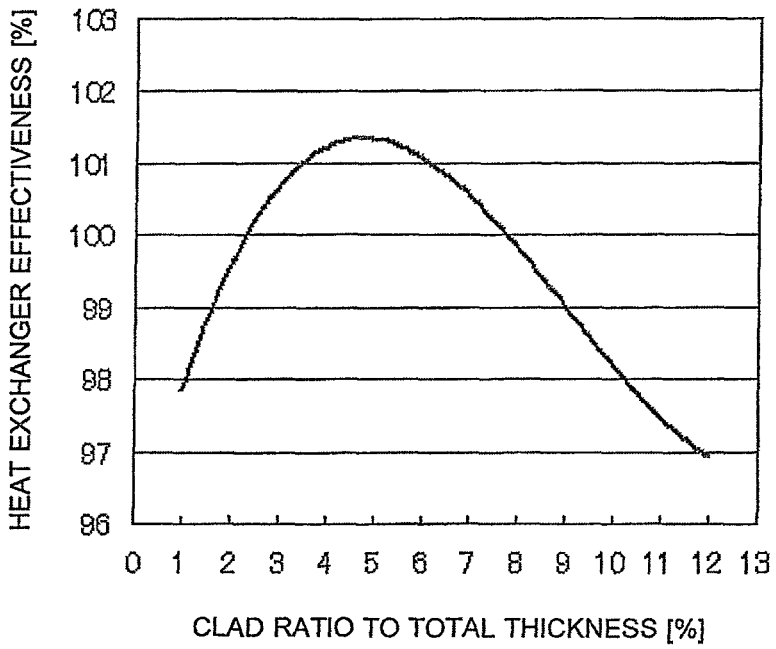
FIG. 6 is a graph illustrating the relation between the thickness of a brazing-clad material 15 and heat exchanger effectiveness in Embodiment 3 of the present invention.

FIG. 6 is a graph illustrating the relation between the thickness of a brazing-clad material 15 and heat exchanger effectiveness in Embodiment 3 of the present invention. In FIG. 6, the axis of abscissas denotes, as a clad ratio (percentage), the ratio of the thickness of the brazing-clad material 15 to the total thickness (length in a direction along the short side of the cross-section) of a flat tube 12. The axis of ordinates denotes the heat exchanger effectiveness (percentage).

For example, when the clad ratio is too low (about less than three percent), brazing filler metal for joining a fin 11 and a flat tube 12 is insufficient, thus resulting in poor joining. This leads to lower heat exchanger effectiveness. On the other hand, when the clad ratio is too high (about greater than seven percent), a clearance between the fin 11 and the flat tube 12 is increased upon melting of the brazing-clad material 15. When the clearance between the fin 11 and the flat tube 12 along each long side of the cross-section of the flat tube 12 is increased, brazing filler metal cannot be held in the clearance, thus resulting in poor joining. In addition, brazing filler metal on long-side outer circumferential surface parts of the flat tube 12 becomes insufficient and a large amount of brazing filler metal flows over a short-side outer circumferential surface part thereof. Excess brazing filler metal accordingly reduces the spacing between the fins 11, thus increasing air side pressure loss (air flow resistance). Consequently, the heat exchanger effectiveness is reduced.

Accordingly, the heat exchanger is preferably configured such that the fins 11 and the flat tubes 12 in each of which the ratio of the thickness of the brazing-clad material 15 to the total thickness of the flat tube 12 ranges from three to seven percent are joined.

Embodiment 4

Figure 7:
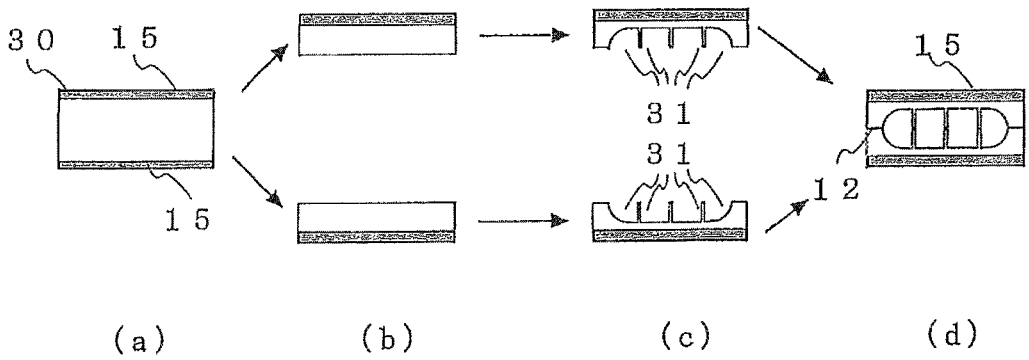
FIG. 7 is a diagram explaining a method of manufacturing a flat tube 12 according to Embodiment 4 of the present invention.

FIG. 7 is a diagram explaining a process of manufacturing a flat tube 12 according to Embodiment 4 of the present invention. An exemplary method of manufacturing the flat tube 12 in Embodiment 4 will be described with reference to FIG. 7. In Embodiment 4, a billet 30, which is typically commercially available, including a brazing-clad material 15 and a base metal covered with the brazing-clad material 15 is used as a material (FIG. 7(*a*)).

The billet 30 is divided into pieces (FIG. 7(*b*)). Recesses 31, serving as refrigerant passages 14, are formed in each cut surface (FIG. 7(*c*)). The above-described spiral groove is also formed simultaneously with the formation of each recess 31. The cut surfaces (having the recesses 31) are opposed and joined together, thus forming the flat tube 12.

Since the billet 30 which is the base metal covered with the brazing-clad material 15 is processed, the time and cost of processing can be reduced.

Although the commercially available billet 30 including the brazing-clad material 15 is used in Embodiment 4, the flat tube 12 may be formed by another method. For example, the refrigerant passages 14 may be formed in a billet by extrusion, thus manufacturing the flat tube 12. After that, the flat tube 12 may be coated with brazing filler metal, thus forming the brazing-clad material 15 on the surface of the flat tube 12.

Embodiment 5

Figure 8:
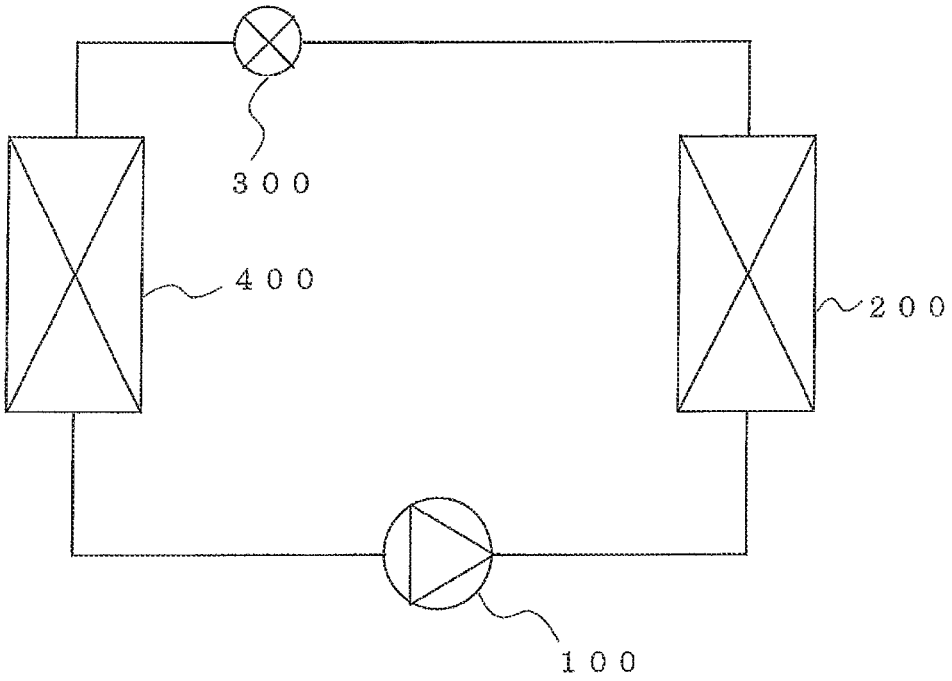
FIG. 8 is a diagram illustrating the configuration of a refrigeration cycle apparatus according to Embodiment 5 of the present invention.

FIG. 8 is a diagram illustrating the configuration of a refrigeration cycle apparatus according to Embodiment 5 of the present invention. The refrigeration cycle apparatus of FIG. 8 includes a compressor 100, a condenser 200, an expansion valve 300, and an evaporator 400 connected by pipes to provide a refrigerant circuit (refrigerant circuit). As regards levels of temperature and those of pressure, the levels are not determined in relation to a particular absolute value, but are relatively determined depending on, for example, a state or operation of a refrigerant or the like in the apparatus.

The compressor 100 sucks the refrigerant, compresses the refrigerant into a high-temperature high-pressure state, and then discharges the refrigerant. The compressor 100 may be of a type in which a rotation speed is controlled by, for example, an inverter circuit so that the amount of refrigerant discharged can be controlled. The condenser 200, serving as a heat exchanger, exchanges heat between the refrigerant and air supplied from, for example, a fan (not illustrated) to condense the refrigerant into a liquid refrigerant (or condense and liquefy the refrigerant).

The expansion valve (pressure reducing valve or expansion device) 300 reduces the pressure of the refrigerant to expand it. Although the expansion valve 300 is flow control means, such as an electronic expansion valve, the expansion valve 300 may be refrigerant flow control means, such as an expansion valve including a temperature sensitive cylinder or a capillary tube (or capillary). The evaporator 400 exchanges heat between the refrigerant and air or the like to evaporate the refrigerant into a gaseous (gas) refrigerant (or evaporate and gasify the refrigerant).

The heat exchanger including the flat tubes 12 described in any of Embodiments 1 to 4 can be used as at least one of the evaporator 400 and the condenser 200. Consequently, the heat transfer performance can be increased. The increased heat transfer performance enables the refrigeration cycle apparatus to have high energy efficiency and achieve energy saving.

Operations of the components of the refrigeration cycle apparatus will now be described in accordance with the flow of the refrigerant circulated through the refrigerant circuit. The compressor 100 sucks the refrigerant, compresses the refrigerant into a high-temperature high-pressure state, and then discharges the refrigerant. The discharged refrigerant flows into the condenser 200. The condenser 200 exchanges heat between the refrigerant and air supplied from a fan to condense and liquefy the refrigerant. The condensed and liquefied refrigerant passes through the expansion valve 300. The expansion valve 300 reduces the pressure of the condensed and liquefied refrigerant passing therethrough. The pressure-reduced refrigerant flows into the evaporator 400. The evaporator 400 exchanges heat between the refrigerant and, for example, a heat load (heat exchange target) to evaporate and gasify the refrigerant. The evaporated and gasified refrigerant is sucked by the compressor 100. Although the evaporator 400 exchanges heat between the refrigerant and the heat load, the condenser 200 may exchange heat between the refrigerant and the heat load to superheat the heat load.

INDUSTRIAL APPLICABILITY

Although the heat exchanger included in the indoor unit of the air-conditioning apparatus has been described in, for example, Embodiment 1, the present invention is not limited to this example. The present invention can be applied to a heat exchanger included in an outdoor unit of the air-conditioning apparatus. Furthermore, the present invention can be applied to a heat exchanger used as an evaporator or condenser in another refrigeration cycle apparatus.

The invention claimed is:

1. A heat exchanger comprising:

a plurality of plate-shaped fins arranged at intervals such that air flows between adjacent fins, and each of the fins having insertion holes; and a plurality of flat tubes extending through the fins such that a refrigerant flows through the tubes in a stacking direction of the fins, each of the flat tubes having a cross-section having straight long sides and half-round short sides, each flat tube having long-side outer circumferential surface parts and a short-side outer circumferential surface part in contact with the fin which are covered with the brazing filler metal, wherein the fins and the flat tubes are joined with the brazing filler metal covering the flat tubes such that top part of each fin collar of each fin is in contact with the flat tube, base part of the fin collar is spaced apart from the flat tube, and the brazing filler metal covering the long-side outer circumferential surface parts has a thickness ranging from three to seven percent of a total thickness of the flat tube.

2. A heat exchanger comprising:

a plurality of plate-shaped fins arranged at intervals such that air flows between adjacent fins, and each of the fins having insertion holes; and a plurality of flat tubes extending through the fins such that a refrigerant flows through the tubes in a stacking direction of the fins, each of the flat tubes having a cross-section having straight long sides and half-round short sides, each flat tube having long-side outer circumferential surface parts and a short-side outer circumferential surface part in contact with the fin which are covered with the brazing filler metal, wherein the fins and the flat tubes are joined with the brazing filler metal covering the flat tubes such that top part of each fin collar of each fin is in contact with the flat tube, base part of the fin collar is spaced apart from the flat tube, and the brazing filler metal covering the short-side outer circumferential surface part of the flat tube is thinner than the brazing filler metal covering the long-side outer circumferential surface parts thereof.

3. A method of manufacturing the flat tube of the heat exchanger of claim 1, the method comprising:

dividing a plate previously covered with brazing filler metal into pieces;

forming recesses, each serving as a refrigerant passage, in a cut surface of each divided piece of the plate; and joining the divided pieces of the plate such that the recesses are facing each other.

4. A refrigeration cycle apparatus comprising:

a compressor configured to compress a refrigerant and discharge the refrigerant;

a condenser configured to condense the refrigerant by heat exchange;

an expansion device configured to reduce a pressure of the condensed refrigerant; and an evaporator configured to exchange heat between the pressure-reduced refrigerant and air to evaporate the refrigerant, the compressor, the condenser, the expansion device, and the evaporator being connected by pipes to provide a refrigerant circuit, wherein at least one of the condenser and the evaporator is the heat exchanger of claim 1.

5. A method of manufacturing the flat tube of the heat exchanger of claim 2, the method comprising:

dividing a plate previously covered with brazing filler metal into pieces;

forming recesses, each serving as a refrigerant passage, in a cut surface of each divided piece of the plate; and joining the divided pieces of the plate such that the recesses are facing each other.

6. A refrigeration cycle apparatus comprising:

a compressor configured to compress a refrigerant and discharge the refrigerant;

a condenser configured to condense the refrigerant by heat exchange;

an expansion device configured to reduce a pressure of the condensed refrigerant; and an evaporator configured to exchange heat between the pressure-reduced refrigerant and air to evaporate the refrigerant, the compressor, the condenser, the expansion device, and the evaporator being connected by pipes to provide a refrigerant circuit, wherein at least one of the condenser and the evaporator is the heat exchanger of claim 2.

* * * * *